US006074522A

United States Patent [19]

Seymour

[11] Patent Number: 6,074,522

[45] Date of Patent: Jun. 13, 2000

[54] PROCESS TO OPTIMIZE PULP WASHING VARIABLES

[76] Inventor: George W. Seymour, 2841 Parkwood Dr., Brunswick, Ga. 31520

[21] Appl. No.: 08/904,752

[22] Filed: Aug. 1, 1997

[51] Int. Cl.[7] ..... D21C 7/14; D21C 9/02

[52] U.S. Cl. ..... 162/49; 162/60; 162/252; 162/258; 162/263; 162/DIG. 10

[58] Field of Search ..... 162/49, 60, 198, 162/263, 252, 258, DIG. 10; 8/156, 158; 364/471.01, 471.03

[56] References Cited

U.S. PATENT DOCUMENTS

| | | | |
|---|---|---|---|
| 4,207,141 | 6/1980 | Seymour | 162/49 |
| 4,840,704 | 6/1989 | Seymour | 162/49 |
| 4,869,784 | 9/1989 | Seymour | 162/49 |

FOREIGN PATENT DOCUMENTS

| | | | |
|---|---|---|---|
| 1203407 | 4/1986 | Canada | 162/60 |

OTHER PUBLICATIONS

Perkins, J.K., Brown Stock Washing Using Rotary Filters, Tappi Press (Undated), pp 1–17, 19–23, 25–31, 33–37, 39–43, 45–51, 53–55.

Crotogino et al, "The priciples of pulp washing", Tappi Journal, Jun. 1987, pp 95–103.

Perkins et al, "Brown Stock Washing Efficiency", Tappi, vol. 37, No. 3, Mar. 1954.

McCollister, "Optimization of Brown Stock Drum Washer Systems", Tappi, vol. 62, No. 12, Dec. 1979.

G.A. Smook, Handbook for Pulp & Paper Technologists, 2nd, (Vancouver, B.C.:Angus Wilde Publications, 1992), 253–255.

*Primary Examiner*—Peter Chin

[57] ABSTRACT

A method for washing pulp in a multistage pulp washing operation involves controlling operating conditions so as to maximize the efficiency of the operation particularly in response to determination of the percent consistency off the discharge side of each drum washer. The major variables that are useful to control are vat dilution flow, drum speed, vat level set point, drainage aids or defoamers, press roll pressures, vacuum break position, and temperature of the last stage showers.

9 Claims, 1 Drawing Sheet

PROCESS TO OPTIMIZE PULP WASHING VARIABLES

TECHNICAL FIELD

The present invention relates to a method to control various factors in a pulp washing operation in response to the determination of the discharge percent consistency off each drum in a series of drum washers and thereby increase the efficiency of the washing process.

BACKGROUND OF THE INVENTION

In conventional systems the percent consistencies off the drums of a pulp washing system are not measured because there has been no known method by which to measure them except by hand sampling and lab testing. The operators run by experienced observation only and no measurements of the percent consistency are routinely made and no target percent consistency is ever established for the operator even as a guide. The percent consistencies off the drums are recognized as important variables but no means have been available to continuously measure and control them.

The normal operating procedure is usually one of the following four methods.

A. The operator uses his experience of observation to control the drum speed and vat dilution such that the pulp mat being formed "looks" about right. Changes are made to these variables periodically as rate changes are made in the incoming pulp to the system or as quality factors such as drainage rate of the pulp change. There is no measurement or control of the discharge percent consistency of the pulp on any of the drums in this control method. The vat dilution flow is not measured but the drum speed is generally indicated.

B. In some systems the operator sets the vat dilution flow by experience to achieve a reasonable vat percent consistency by visual observation and the drum speed is then set on automatic control by an instrument measuring the liquid level in the vat. The vat dilution flow is not measured but the operator knows by experience what valve opening to set on the automatic valve regulating the vat dilution flow. The hydraulic capacity of the drum is proportional to the drum speed but not linearly and if the liquid level rises then the instrument automatically increases the speed of rotation of the drum to bring the level back to the control point. Again, there is no measurement or control of the discharge percent consistency off any of the drums with this method of control even though the vat percent consistency and drum speed both affect the percent consistency of the discharged pulp.

C. The third method of control is less prevalent but is very similar to the second method except that the operator sets the speed of rotation of the drums and the level control instrument then raises or lowers the vat dilution flow to maintain the vat level. As in the two previous methods there is no measurement or control of the discharge percent consistency off any of the drums and also generally no measurement of the vat dilution flow rate. The drum speed is however generally measured.

D. The fourth method of control is described in U.S. Pat. No. 4,840,704 entitled "Controlling Characteristics of a Pulp Mat on a Pulp Washing Surface" whereby the drum speed and vat dilution on the last washer in the line is controlled by use of a mass measuring gauge or similar device on that washer and the object of the patent is to control the total weight per unit area off that one washer drum to a constant value to facilitate the accuracy of the total mass measurement, which is non-linear with respect to the thickness of the pulp mat, and to maintain a relatively constant percent consistency in the vat of the washer at various tonnage rates. This method, like the other three methods, does not measure or control the percent consistency of the pulp leaving any of the washer drums in the pulp washing system.

These methods all fail to determine the percent consistency off any of the drums in a series of drums in a pulp washing system and cannot optimize any of the variables described herein. Additionally, with these methods of control it is not necessary to measure the actual flow of the showers to any except the last stage of washing and therefore these measurements are not made.

In U.S. Pat. No. 4,207,141, to the author of this application (Seymour), a method is described to determine the consistency of the pulp leaving the last stage of washing by using a combination of a capacitance measuring instrument and a total mass measuring instrument but this system was never implemented as no such capacitance device was ever practical.

Following are descriptions of the various parameters that affect the discharge percent consistency of the pulp leaving each individual washer and thereby affect the overall efficiency of the washing process.

Vat Consistency

The vat consistency is regulated by the vat dilution flow that is set by the operator in most cases. As indicated above some mills set the drum speed and allow the vat dilution to increase or decrease for control of the vat level. In efficiency studies with a simulation program, it is determined that the vat consistency has only a small percentage of effect on efficiency compared to the discharge percent consistency from the drum. For this reason the vat consistency can be regulated such that the drum speed and vat level are a matched set of conditions giving the optimum discharge percent consistency. This is normally the maximum sustainable consistency off the drum.

Drum Speed Control

The drum speed control is automatically adjusted as previously explained such that the vat level set point is maintained. There are however an infinite number of matched conditions of vat level, vat dilution and drum speed giving a control system considerable leeway for determining the optimum conditions to produce the maximum discharge percent consistency off the drum.

Dilution Factor Equal on All Stages

The dilution factor on all the washers must average exactly the same dilution factor that is applied to the last washer. This is not easily recognized since it is obvious in normal operations that the consistencies off the drums and the shower flow rates on all the washers are seldom the same and in fact the shower flows to previous washers are not measured and the percent consistencies are only tested by hand sampling and lab tested at rare intervals but never routinely. The dilution factor as defined above is shown to be that portion of the shower liquid applied to the washer that penetrates all the way through the pulp mat web on the washer drum and enters the washer downleg relative to the dry weight of pulp alone in the pulp mat leaving the washer. This is a dimensionless number but can be thought of as being liters (essentially kilograms) of water per kilogram of dry pulp. The reason that all washers must average the same dilution factor as the last washer is that the only source of fresh water to the system is the dilution factor on the last washer and every drop of this water making up the dilution factor must go back through the line of washers in counter-current fashion and eventually leave the pulp washing system and go to the evaporators since there is no provision to continually store this addition of liquid to the system. Liquor spills, wash up water, pump seal water, etc., are excepted as being insignificant. Although there are large filtrate tanks in the liquor system of the pulp washing operation, such that any one gallon of shower water may take many hours to work its way through the system from one end to the other, the pulp on the other hand has no such storage between the first washer drum and the last washer drum. The pulp therefore traverses the entire washing line in a matter of only four to eight minutes in a normal system and the tonnage rate of the pulp is then essentially the same on all washers at the same time. This tonnage rate is usually expressed as the tons of dry pulp alone per twenty four hour day of operation.

The shower flow rates on the washers previous to the last stage washer are generally controlled by an automatic controller set to maintain the level in the following filtrate tank, from which the shower liquor comes, to a constant value. This is sufficient to provide the flow rate necessary so long as this flow rate is then measured and the dilution factor on the washers is known. This level in the large filtrate tanks does not wait for a complete turnover as it is increased or decreased quickly as the flow rates change in and out of the tanks. A real problem is that these tanks must be quite large due to the very large flows through them for vat dilution which can be in the order of 30,000 liters per minute. The tanks therefore are designed to hold some 200,000 liters each. For example suppose a system is in equilibrium and the shower flow to the last washer is 4557 liters per minute, the tonnage rate is 635 metric tons per day, (441 kilograms per minute of dry pulp) with a given dilution factor of 3.0 which then calculates that the percent consistency off the last washer is 12% (example calculation below). Assume normal control of the shower flows to the previous washers based upon the level in the filtrate tanks. By measuring the shower flows on all previous washers it is found that these flows are directly related to the consistencies off the washer drums which can then be calculated as below. Before getting to the calculations however consider that if the percent consistency leaving any particular washer drum (A) is decreased (more water per kilogram of pulp), then the pulp entering the next stage (B) carries with it more volume of water per minute. Then if no change is made to the consistency of the pulp leaving washer (B) this extra volume of water entering the washer must have been removed by the drum (B) and sent to the filtrate tank (B). This will then increase the level in filtrate tank (B) and cause the level controller to increase the shower flow to the drum (A) that had the lower percent consistency pulp leaving it. This is more easily explained by holding constant the discharge percent consistency leaving the B drum but in fact this is not required as any change in this percent consistency is automatically corrected for in the showers on the B washer itself as in the A washer just discussed and the dilution factor remains identical on all washers.

Overall Efficiency

The overall efficiency of the entire washing system is a function of all the variables but can be broken down into the effects of each individual stage. This becomes complex if the various stages are of different types such as a combination of diffusion stages, drum washer stages, and a belt washer group of stages. However even this can be quantified by determining the efficiency of each individual stage and then combining these into the following equation to determine the overall efficiency of the entire system.

$$OE=100\ (1-(1-A/100)(1-B/100)(1-C/100)(1-D/100)(1-E/100)) \quad (1)$$

Where:

OE is the percent overall efficiency

A is the percent efficiency of the A stage

B is the percent efficiency of the B stage

C is the percent efficiency of the C stage

D is the percent efficiency of the D stage

E is the percent efficiency of the E stage

Of course it is understood that this equation is written for a five stage system but it is easily seen that any given number of stages can be represented by simply adding or taking away one or more of the unit stages as in the general equation above. In the above equation the percent efficiency A, B, C, D, and E of each individual stage is represented by the following equation.

$$\text{Percent Efficiency of each stage}=100-100(O/I) \quad (2)$$

Where:

I=Input to the stage in weight of washable material per unit of product washed

O=Output from the stage in weight of washable material per unit of product washed The input to each stage is the weight of dissolved washable material in the pulp mat leaving the previous washer drum, and the output from each stage is the weight of dissolved washable material in the pulp mat leaving that stage itself. It then becomes obvious that the percent overall efficiency becomes one hundred minus the percentage of loss, and the loss is one hundred times the output (loss) from the last stage divided by the weight of washable material entering the first stage.

The inefficiency or loss from each stage is then:

$$\text{A stage Percent Inefficiency}=100-A \quad (3A)$$

$$\text{B stage Percent Inefficiency}=100-B \quad (3B)$$

$$\text{C stage Percent Inefficiency}=100-C \quad (3C)$$

$$\text{D stage Percent Inefficiency}=100-D \quad (3D)$$

$$\text{E stage Percent Inefficiency}=100-E \quad (3E)$$

The weight units do not matter so long as they are consistent. The percent overall efficiency of the entire system is then one hundred times one minus the product of all these inefficiencies as given in equation (1) above. These values are obvious for any given stage in the system except the first stage. In a pulp washing system the input to the first stage is most accurately determined by the sum of the material washed out of the product and sent to the evaporators plus the loss from the last stage. There is so much recycled material both liquids and solids in the pulp entering the vat of number one washer that the above is the most reliable value for the input to the first stage. This recycled material includes the liquor used to make up the total volume in batch digesters, plus blow tank dilution, and plus vat dilution which leaves no point at which the actual weight of material per unit of pulp can be accurately represented. Therefore from the system material balance, where the outputs must equal the inputs, the true feed to the first stage is derived from these well established output values.

From the above equations it can be shown that an increased efficiency in any one stage will give an increased overall efficiency. Secondly it can be shown from equation (1) that a given percentage increase in the efficiency of any one stage accomplishes the same increase in the overall efficiency as an equivalent improvement in efficiency in any other stage. Thirdly, and most important in this invention, is that when the consistency of the discharged pulp is increased from any one stage, the amount of dissolved material leaving that stage is reduced by the reduction in volume. By using a simulation program the amount of improvement in any individual stage efficiency can easily be determined. It is then found that a given change in consistency on any one stage produces that same exact percent change in efficiency on any other stage, and the exact same improved overall efficiency. The mathematics involved in this relationship are quite complex but are easily understood considering that when equilibrium is established the weight of dissolved solids transferred from each stage to the next must equal the final loss off the last washer. This is explained by the fact that there is no place to continue to store liquor or dissolved solids within the washing operation. The washing process must be considered in its entirety for the optimum overall efficiency. The combined use in this invention of determining the consistencies off each washer and the simulation program provide the necessary tools to optimize the entire operation to the best operating parameters. Within the normal operating range of most washing systems using drum type washers the simulation program clearly shows that the optimum operating consistencies off the washers is where the product of the inverse of the individual consistencies off the washers is minimized. In equation form this is:

$$\text{Minimize the following MIN}=(1/CA)(1/CB)(1/CC)(1/CD)(1/CE) \quad (4)$$

Where:

MIN is the value to be minimized for optimum overall efficiency and CA,CB,CC,CD,&CE are the stage percent consistencies respectfully.

This relationship holds true for any number of stages by using the number of terms in that particular washing system and minimizing the value MIN as above by control of the process parameters in response to the consistency determinations.

Definitions

The displacement ratio is defined as:

$$DR=(A-C)\ /\ (A-B) \quad (5)$$

where

DR is the displacement ratio

A=percent dissolved solids in the liquid in the vat of the washer

B=percent dissolved solids in the shower liquid

C=percent dissolved solids in the liquid in discharged pulp mat

The dilution factor is defined as $$DF=(b-c)\ /\ p \quad (6)$$

where

DF is the dilution factor b=the shower flow volume per unit time (liters/min.)

c=the volume of liquid in the discharged pulp per unit time (liters/min.)

p=the weight of dry pulp discharged per unit time (kilograms/min.) rearranged $$c=b-DF(p) \quad (6a)$$

Percent Consistency is defined as:

$$PC=100p\ /\ (p+c) \quad (7)$$

where

PC is the percent consistency p is the weight of dry pulp c is the weight of liquid associated with pulp p (as in Equation (6a))

Derivation of Consistency Equation from Defined Values $$\text{PERCENT CONSISTENCY}=100(p)/(p+c) \text{ substituting for c from rearranged equation } c=b-DF(p) \quad (6a)$$

$$\text{PERCENT CONSISTENCY}=100(p)/(p+(b-DF(p))) \quad (8)$$

Example calculations are below.

This equation is for any individual washer in the line with the values as defined measured or determined on that washer itself. As previously shown the dilution factor is the same for all washers at any given time, the pulp flow rate is also shown to be the same for all washers at the same time with only 4 to 6 minutes for the pulp to traverse all washers, and the shower flow is the measurement on each washer itself. It is understood that during periods of upset or rate changes these factors will vary from and will temporarily be above or below the true average. As shown above these upset conditions cannot long endure since there is no place to store liquor while maintaining a constant level in the filtrate tanks and no place to store pulp within the washing system.

SUMMARY OF THE INVENTION

The present invention relates to control in each stage of the liquid vat level set point, the vat dilution flow, and the drum speed, and preferably also the type and amount of any deaerating agent added, the pressure of any press rolls and the vacuum break setting, so as to increase and preferably maximize the consistency off the discharge side of the filter drum in each stage.

As indicated above, variables are controlled preferably so that the pulp consistency at the discharge side of the drum is maximized. The maximum consistency sustainable off the discharge side of a drum gives the lowest amount of liquor carryover to the following stage and therefore improves the overall efficiency of the system.

The method of determining the percent consistency of the pulp off the discharge side of each drum washer in a series of drum washers in a pulp washing system uses the known dilution factor and a measurement of the shower flows on all drums. The shower flow rate is not required in the normal control of the washing operation and it is not normally measured. The lowest cost optimum is generally the maximum sustainable percent consistency obtainable at the discharge of each drum. The percent consistency off the discharge of each drum is determined in this invention by using a system wherein the dilution factor is controlled, the shower flows are measured on all washers and the incoming tonnage rate to the system is measured. The determination of the actual percent consistency off the washer drums has never before been possible except by hand sampling and testing of the washer drum discharge pulp mat. The equation for determining percent consistency off a washer drum from the aforementioned parameters is Equation 8 set forth above.

We turn now to the invention with more particularity. The process of the instant invention is one for controlling a continuously operated wood pulp washing system. The system is for removing dissolved impurities from the pulp and contains a series of countercurrent stages of drum washers. The drum washer of each stage comprises a vat and a continuously moving vacuum filter drum having as a surface, a screen wire having a lower portion protruding into the vat. The speed of movement of the continuously moving vacuum filter drum is called drum speed. The drum washer of each stage is associated with a filtrate tank. In each stage, the following occurs. Incoming pulp may be treated with deaerating aids (also known, for example, as washing aids, defoamers, and antifoam agents). These are used to release air from the pulp and liquor. The incoming pulp is diluted with a flow of filtrate (as defined below) from the same stage before entering the vat of that stage. This flow of filtrate is called the vat dilution flow. A pulp mat is formed by draining of a portion of liquid from a pulp suspension in the vat leaving a pulp mat on the screen wire having a higher consistency than the pulp suspension in the vat and forming a filtrate. The filtrate passes through apertures in the screen wire and into the filtrate tank for the stage where the pulp mat is formed. The filtrate tank is located below the drum washer of that stage such that a vacuum is pulled on the interior of the drum washer to suck liquid out of the pulp suspension to form the pulp mat. A liquid level is maintained in the vat at a set point selected when the system is in proper balance between the vat dilution flow and the drum speed that regulates the hydraulic capacity of the system. The pulp mat formed on the screen wire is transported with the drum to encounter a shower flow coming from the filtrate tank of the following stage except for the final stage where the shower flow is fresh water. The vacuum in the vacuum drum sucks a portion of the shower flow through the pulp mat on the filter drum. The weight of the portion of the shower flow that is sucked through the pulp mat divided by the dry pulp flow which is the weight of wood pulp in the pulp mat without the associated water in the pulp mat is called the dilution factor. The pulp mat is transported past the shower flow under a press roll where one is present to press out more of the liquid from the pulp mat and thereby increase the consistency of the pulp mat. The pulp mat is then transported to the discharge side of the vacuum drum where an internal valve of the washer releases vacuum from a portion of the vacuum drum called the vacuum break. The pulp mat is then discharged from that drum into the beginning of the following washing stage or from the system in the case of the final stage. The washing system can be a brown stock washing system. Alternatively the washing drums can be a bleaching process.

The process of the instant invention comprises, in each stage, evaluating the influence of change in and adjusting and controlling the liquid vat level set point, the vat dilution flow and the drum speed in response to determination of the percent consistency of the pulp mat at the discharge side of that stage. In a process where deaerating agents are added in each stage in to the pulp upstream of the vat of that stage, preferably the type and amount of deaerating agent is controlled in response to the determination of the percent consistency at the discharge side of the stage. In a process where the system contains press rolls, the pressure of the press rolls in a stage is regulated in response to the determination of the consistency at the discharge side of the stage where the press rolls are present. Preferably, the vacuum break setting in each stage is set in response to the determination of the percent consistency at the discharge side of the stage.

The term "consistency at the discharge side of a stage" is used herein to mean the consistency of the pulp mat after leaving the drum washer of a stage and before entering the next stage or in the case of the final stage before being discharged from the process.

The evaluation, adjustment (one time setting) and control of the various parameters in a stage in response to determination of percent consistency in a stage means that changes in the parameters are evaluated for effect on percent consistency as determined at the discharge side of a stage and the parameters are adjusted and controlled to increase said percent consistency and preferably to maximize said percent consistency.

Evaluating the influence of change in the liquid vat level set point, the vat dilution flow and the drum speed, mentioned above, can involve the evolutionary operations method described hereinafter. It is a standard procedure in statistical control which is described in many text books. See, for example, Chapter 11 titled "The Determination of Optimum Conditions," at pages 495–579 of The Design and Analysis of Industrial Experiments, Owen L. Davies, editor, Hafner Publishing Company, New York, which is incorporated herein by reference. Other statistical procedures are also applicable such as an analysis of variance of four factors combined to give the effects of each of the three independent variables on the dependent variable. Computer programs can be written to do these analyses.

As indicated above, increasing percent consistency at a discharge side of a stage increases the efficiency of the washing process in that stage and in the entire process.

As indicated above, determination of percent consistency at the discharge side of a stage is a requirement of the invention, and this has not been accomplished before this invention. The percent consistency in the pulp mat at the discharge side of at stage is determined from shower flow rate, dry pulp flow rate, and dilution factor by Equation (8) set forth above. The dry pulp flow rate can be determined from the inlet flow, and consistency measurements at the beginning of the process, and as indicated above is essentially constant through the process. The dilution factor can be calculated according to Equation (6) hereinbefore and is the same in all stages. We turn now the shower flow rate. This is measured and controlled. This is normally controlled for the showers previous to the last stage washer by control of the level in the filtrate tank from which they come and is generally controlled by an automatic controller set to maintain the level in the following filtrate tank. Preferably the amount of shower flow applied to the last washing stage is controlled in one of the following ways: (1) The amount of shower flow applied to the last washing stage is controlled in response to dilution factor that is determined by the cooling effect of the dilution factor volume on the liquor volume in the filtrate tank of the last stage and the temperature of the liquid in the filtrate tank in a previous stage. (2) The amount of shower flows applied to the last washing stage is controlled in response to the dilution factor that is determined by the diluting effect produced by the dilution factor volume on the percent solids in the last stage filtrate tank and the percent solids in the filtrate of a previous stage. The term "dilution factor volume" is used herein to mean the volume of that portion of the shower flow that is the dilution flow, which numerically is the dilution factor times the weight of dry pulp alone discharged from the washer drum. The term "a previous stage" is used in (1) and (2) to mean any previous stage but the effect appears to be most sensitive to the control when "a previous stage" is a stage in the middle of the system such as the second in a four stage system or the third in a five stage system or the second in a three stage system or the third in a six stage system.

DESCRIPTION OF THE PREFERRED EMBODIMENTS

Figure 1:
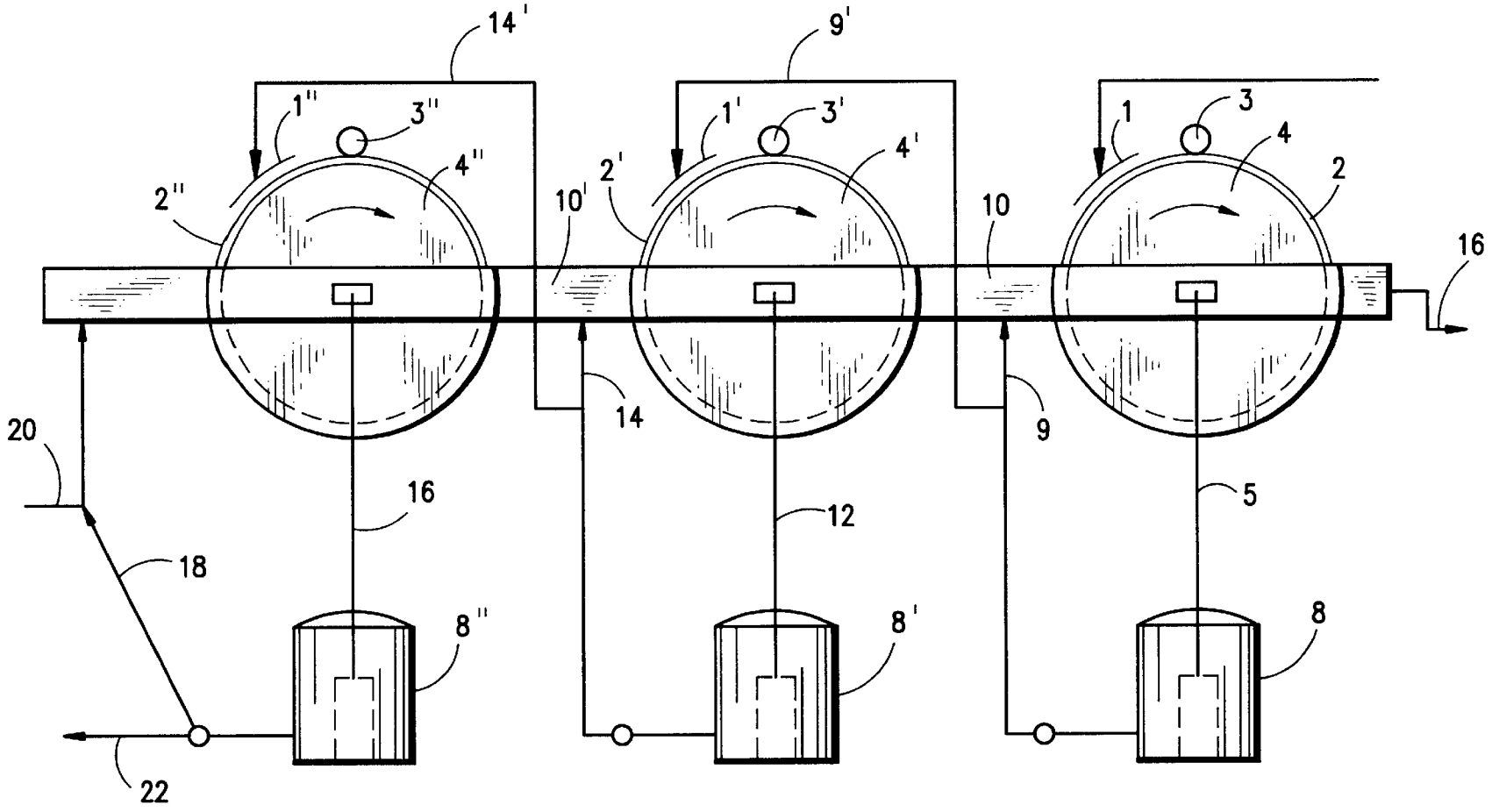
FIG. 1 is a flow schematic of a three stage countercurrent pulp washing operation showing the major points explained in detail below in the description of the preferred embodiments of the invention.

The present invention can be applied to pulp washing in general but can be explained in terms of the three stage system depicted in FIG. 1. Referring to FIG. 1 the pulp from the pulping area of the pulp mill enters the washing system at point 20 and is diluted with the filtrate from the first filtrate tank 8" via line 18 and enters the vat of the first washer at the arrow above point 20. This pulp slurry is then at about 1.0 to 2.0 percent consistency with liquor being 98 to 99 percent of the total weight. The washing drum 4" which is covered with a screen type wire 211 then pulls a portion of the liquid through the wire by virtue of the vacuum created in the drum by the liquid falling down the downleg 16 into the first filtrate tank 8". The pulp remaining on the surface of the wire 2" is thus thickened to some 10 to 20 percent consistency and is transported by the moving drum under the shower flow 1", and discharged into the headbox of the following washer 10' where it is diluted by filtrate from the second filtrate tank 8' via line 14 as it then enters the vat of the second washer. The washing drum 4' which is covered with a screen type wire 2' pulls a portion of liquid through the wire by virtue of the vacuum created in the drum by the liquid falling down the downleg 12 into the second filtrate tank 8'. The pulp remaining on the surface of wire 2' is thus thickened and is transported by the moving drum under shower flow 1' and discharged into the headbox of the following washer 10 where it is diluted by filtrate from the third filtrate tank 8 via line 9 as it enters the vat of the third washer. The washing drum 4 which is covered with a screen type wire 2 pulls a portion of liquid through the wire by virtue of the vacuum created in the drum by the liquid falling down the downleg 5 into the third filtrate tank 8. The pulp remaining on the surface of wire 2 is thus thickened and is transported by the moving drum under shower flow 1 whereupon vacuum in drum 4 removes water from the pulp mat which is then discharged from the system at 16. Filtrate is supplied for shower flows 1' and 1" respectively by lines 9' and 14'. Fresh water is supplied for shower flow 1. The flows in lines 18, 14 and 9 are called vat dilution flows. As explained herein it is seen on FIG. 1 that the only inputs into this system are from line 20 where pulp enters the system and the fresh water shower flow 1 on the last washer 4. Washed pulp exits the system at 16 and accumulated excess filtrate is removed from the system at 22. Although it is not obvious when running the system, it is seen that the dilution factor as defined herein must be the same on each washer since no provision is available to continuously store liquor in the system. The pulp leaving each washer drum has been thickened to a previously unknown consistency but with the measurement of the shower flows 1" and 1' combined with the known dilution factor it is now possible to determine the consistency of the pulp as it enters the headbox of the following washers 10' and 10 before the vat dilutions 18 and 14. With this consistency now being a known value, it becomes possible to adjust the liquid vat level set points, the vat dilution flows and the speed of rotation of the drums 4" and 4' so as to produce the maximum consistency off the drums as influenced by these variables and thus improve the efficiency of the process. Likewise, it is now possible to determine the consistency of the pulp as it is discharged from the last washer. With this consistency now being known, it is possible to adjust the liquid vat level set point, the vat dilution flow and the speed of rotation of drum 4 so as to produce the maximum consistency off the drum as influenced by these variables and thus improve the efficiency of the process.

The vat level set point is maintained as previously discussed by the drum speed; however, the chosen set point of this vat level is another thing entirely. Just as the drum speed can lower the vat level by increasing the rotational speed of the drum, this lower vat level can also be maintained by this increased drum speed and lowering the set point of the vat level control. This gives an entirely different set of conditions that can be set in response to the percent consistency off the discharge side of each drum and by optimization can improve the efficiency of the system.

The temperature of the shower water 1 on the last washer is normally about 65 degrees Centigrade. The temperature of the entire system is affected by this shower temperature since it is the only cooling effect in the entire system. One of the major effects of temperature throughout the system is to affect the discharge consistency off the drums into the following headboxes 10' and 10. This shower temperature can be optimized by adjustment in response to the percent consistency of the pulp leaving the drums.

Antifoam agents or defoamers or drainage aids which are referred to herein as deaerating aids are often added to the pulp just prior to points 20, 14 and 9 to improve the drainage rate, reduce air entrained in the pulp and liquor, and to reduce the foaming in the liquor all of which are deleterious to the washing operation and specifically to the discharge percent consistency leaving the drum as entrained air is one of the major factors in thickening of the pulp mat. These chemical agents can be adjusted to optimize the total cost by adjusting them in response to the actual determined consistency discharged into points 10', 10 and 16 of FIG. 1.

Some washer systems have press rolls 3", 3', 3 in FIG. 1 to press liquid out of the pulp mat and are located just after the showers 1",1', and 1. The purpose of these press rolls is to increase the consistency of the pulp mat before discharge. Due to the difficulty of operation of these rolls they have been abandoned by most mills even though they do improve the efficiency of the process when it is possible to control them. By adjusting the pressure on these press rolls in response to the percent consistency off the discharge side of the drums, i.e., 10', 10 and 16, the efficiency of the process can be improved.

Each drum is built such that the vacuum that is pulled on the system is contained within a certain segment of the drum starting near the discharge side of the drum but below the level of the pulp slurry in the vat. This allows the liquor to flow through the wire and into the drum and leaving the pulp outside the wire to form a mat on screens 2", 2' and 2 on the drums. This liquor then flows through channels and pipes within the drum and is discharged into the downlegs 16, 12 and 5 such that a vacuum is pulled on the drums. The pulp mats so formed are then treated with shower liquid 1", 1', and 1 which is pulled through the mat by the vacuum within the drum. This vacuum is segmented off within the drum so that several feet past the last shower pipe, and past a press roll if any, the vacuum is still pulling liquid out of the pulp mat. There comes a point however where the vacuum must be released before the pulp mat is discharged from the drum. This is done in a valve arrangement near the hub of the drum wherein the internal pipes are sealed off as they rotate on the hub to the valve that sets the position of the vacuum break. This valve is adjustable within narrow limits but the exact position of the vacuum break, i.e., the vacuum break setting, is important as operating conditions are changed. The exact position of this vacuum break can be set in response to the percent consistency off the drums and improve the efficiency of the system.

The liquid shower flow to the last washer can be controlled to a dilution factor by measuring the temperature of the liquors in two filtrate tanks such as 8" and 8 in FIG. 1. The only cooling effect of the liquor recovered going to the evaporators 22 is from the final shower water 1 entering the system and a small heat loss that can be quantified and corrected for in setting the shower flow.

Additionally the final shower flow rate 1 can be controlled to a dilution factor that is in response to the percent solids in two filtrate tanks 8", 8 that are separated by one stage of wash.

Vat Level Set Point Control

The vat level is normally controlled by an automatic controller that increases the drum speed when the level in the vat rises above the set point and slows down the drum speed when the level is below the set point. This set point however is chosen by the operator and has a definite effect on the pulp consistency leaving the drum. If the set point is too high, then there is too little time for drainage of the mat before the first line of showers which disrupts the mat formation. On the other hand too low a set point gives too little time for mat formation in the vat. This set point can be optimized by correlating it with the consistency at the discharge of the drum to produce the maximum efficiency, i.e., to produce the maximum consistency at the discharge side of the drum.

Vat Dilution Flow Control

The vat dilution is generally set by the operator to achieve a vat consistency of something between 1 and 2 percent consistency in the vat of the washer, such that the washer drum speed and vat level control are able to maintain a balance and produce a pulp mat that looks about right from past experience. This cannot be the optimum to produce the maximum consistency off the drum discharge since no measurement is made of this consistency to guide the operator. This situation is changed however when the consistency of the pulp discharged is known. With a known consistency off the discharge side of the washer drum it is then possible to increase or decrease the vat dilution flow and allow the control system to maintain the vat level by increasing or decreasing the drum speed and to determine the change in consistency produced by this change. This procedure is called evolutionary operations and small incremental changes are then made periodically in the direction of increased consistency off each drum within certain limits. These limits are set by management or they are often imposed by the equipment such as maximum valve opening or a set maximum drum speed. Where no limiting condition is reached, the optimum conditions are then obtained automatically by the evolutionary operations.

Drum Speed Control

Drum speed control is linked directly to the vat dilution flow control and the vat level control within fairly narrow limits. In the evolutionary operation described above under vat dilution flow control, the drum speed is shown to be automatically increased or decreased as the vat dilution flow is increased or decreased. This is modified somewhat in actual operations by the actual vat level set point and also by the dilution factor since that potion of the shower flow is also part of the liquid entering the drum and influences the hydraulic capacity of the system. If the dilution factor is changed, then the above evolutionary operation must seek the optimum balance of the factors involved which are the vat dilution flow, the vat level set point, and the drum speed to produce the maximum discharge consistency off the drum.

Deaerating Aids

Entrained air is a serious and costly problem in the washing of pulp slurries. Excessive air entrained in the pulp from previous operations or even caused by steps in the washing process itself cause foam accumulations which require defoaming chemicals to control along with mechanical foam breaking devices. Chemicals such as soaps, and finely divided solids that are naturally in the liquors being washed out of the pulp contribute to the air entrainment problems. Additionally some of this entrained air is retained in the pulp slurry through the washing process and retards the drainage of the washing liquid through the pulp with consequently lower consistencies leaving the washer drums. These lower consistencies cause a loss in washing efficiency as previously shown. It is known that several different deaerating chemicals called by various names such as defoamers, anti-foam agents, and washing aids are used to alleviate the problems caused by this entrained air. It is not unusual for a pulp mill to consume over two dollars worth of these chemicals per ton of pulp in this regard. The amount of these chemicals used is set by the operator by simple visual observations of the process. With no actual measurements of any kind to guide the operator the safe side is to always have more than the required amount since an excess causes no trouble other than expense. It is well known that the usage of these chemicals can always be reduced simply by closer attention to their use but that also costs time and effort. The key to the control of these chemicals is to determine the consistency and regulate the deaerating aids to maintain the lowest cost operation. The optimum amount of chemicals to be applied are of course the point at which the incremental chemicals cost per ton of pulp becomes greater than the benefits received from increased consistency due to increased chemical additions. This point can be determined for any individual mill using the consistency as determined herein and can be determined for several different control chemicals to determine the optimum amount and the optimum control chemical to be used in that particular mill. Without the consistency determinations as in this invention these evaluations are simply based upon the control of foam alone instead of the overall optimization of the cost effectiveness of the control chemicals. Thus, consistency determination adds a whole new dimension to the cost control of deaerating.

Press Rolls

Press rolls are frequently installed on drum type washers between the last shower and the vacuum break near the top of the drum in a stage. The pressure on these press rolls can be regulated by a system of levers connected to cylinders operated by compressed air or some other means such that the pressure per linear inch across the face of the drum can be adjusted. More pressure per linear inch tends to press out more liquid from the pulp web but excessive pressure causes the web to crush and roll up and can in fact cause more harm than good to the washing operation. A properly operated press roll can increase the consistency of the web leaving the drum and can therefore generally improve the efficiency of the washing operation. Due to the great difficulty of adjusting the pressure per linear inch to be applied to press rolls without causing problems, many mills have either elected to not install them to begin with or have abandoned them. The problem of the proper pressure setting on the press rolls can be solved by setting it in response to the consistency off the drums. This target consistency is determined by experience on each line such that it is below the point at which trouble is experienced. The consistency of the pulp web is steadily increased by increasing the pressure on the press rolls up to the point that crushing of the web is experienced and this limiting consistency can be closer approached by the present invention and therefore the efficiency of the system is improved. Without this preferred feature of the present invention, increasing the pressure to maximize consistency is not plausible. If it were, then the press roll people would have put in a camera to show when crushing took place. Actually as pressure is applied to a press roll, there is a small amount of what appears to be crushed stock built up at the nip of the roll long before actual crushing takes place and long before the maximum consistency is reached. This roll of wet pulp is obvious but does not represent the point at which one must back off the pressure. The press rolls are grooved rolls that tend to grab the wet mat and force it under the roll and can and do operate well with a small wet mass of pulp riding and rolling between the press roll and the pulp mat being pressed. Real crushing causes the pulp mat to build up uncontrollably and shuts the system down.

Vacuum Break

The vacuum break on washer drums is generally set when the washer is installed and is seldom if ever changed. This does not mean that it is correctly set. The position of this vacuum break can be optimized to give the maximum efficiency possible only by determining the discharge consistency on a routine basis over the range of conditions normally run on this line of washers. The position of the vacuum break can be adjusted as follows: The vacuum break is set by hand by shutting down the system, loosening the bolts that hold the valve in position, turning the valve slightly by hand and re-tightening the bolts.

Temperature of Shower Water

It is known that the temperature of the shower water on the last stage, and therefore the temperatures throughout the system, has an effect on the discharge percent consistency of the pulp leaving the washer drums. Shower water with an excessively high temperature can cause the pulp to be fluffy or possibly to retain too much air and on the other hand shower water that is too cold causes problems of drainage and getting the dissolved solids out of the pulp mat. Getting the optimum temperature in a pulp washing system has always been a matter of operator experience since the degree of control over the other variables has not been sufficiently accurate to detect small improvements possible by small adjustments in the shower water temperature. High temperature shower water combined with a low dilution factor can cause an excessive temperature in the first stage vat and downleg whereby the liquor tends to flash under the normal vacuum and thereby reduces the vacuum. This in turn will cause a lower than optimum discharge percent consistency off the first washer drum and in the extreme will cause the washer vat to run over. This can happen during the normal swings in dilution factor where the degree of control over this function is poor. By setting the chosen temperature of the shower water in response to the effect on the drum discharge consistencies this function can be optimized.

The Effect of Vacuum

The amount of vacuum in the downleg from the washer has a large influence on the discharge percent consistency of the pulp leaving the washer. A high vacuum is not always good as it can sometimes be the result of sealing over of the wire and produce a low percent consistency pulp discharge. This is more prevalent when running hardwood pulp. Vacuum is influenced by the amount of air pulled through the pulp web, the condition and design of the downleg (leaks or no leaks), the temperature of the liquor (flashing in the first stage), defoamer or drainage aid usage, drainage rates of the pulp, the specific loading of the washer related to the design of the downleg, the position of the vacuum break valve in the washer drum, and the percent consistency of the pulp in the vat of the washer.

Previous Published Conclusion

Previously published theoretical calculations have shown that increasing the discharge percent consistency off the drums of pulp washers in a pulp washing system increases the theoretical displacement ratio (FIG. 5.14 on page 30 of Perkins, J. K., "Brown Stock Washing Using Rotary Filters", Tappi Press) but the conclusions in this publication were that "There is not a great difference in displacement ratios as the discharge consistency changes from 14 to 18%. This demonstrates that an incremental change in vacuum—and therefore discharge consistency—is sometimes not particularly significant". A greatly improved multistage simulation program however shows that even at a constant displacement ratio, the efficiency of the washing process is considerably improved with increased discharge percent consistency off the drums by an entirely different mechanism. This improved efficiency is due primarily to the lower amount of dissolved solids carryover to the next stage by virtue of the lower amount of liquid in the pulp mat at the higher percent consistencies and not by simply increasing the displacement ratio. These two factors together act synergistically to give a very significant improvement in pulp washing. With the kilograms of dissolved solids carryover reduction, while the liquor flowing countercurrent remains constant at a constant dilution factor, the concentration in the various filtrate tanks is reduced thus giving an improved wash. This degree of improvement in pulp washing, due to this invention, of optimizing various factor that affect the consistency off the washer drums, can be shown to be quite significant even at a constant displacement ratio.

The shower water flow to the last washer can be controlled to a given dilution factor by any one of the methods given in U.S. Pat. No. 4,207,141, or U.S. Pat. No. 4,869,784 which are both assigned to the author of this invention. However, the novel methods of controlling shower flow to the last washer which are set forth herein in preferred aspects of the invention are highly preferred. The novel methods of control of shower flow herein have in common with the methods of the patents that the dilution factor is controlled to a known value on the last washer. Any other system that controls the dilution factor to a known value would be useful herein.

Screw presses in series have the same relationship as a series of drum type washers with respect to consistency at the discharge end and the dilution factor. A given dilution factor on the last screw press provides exactly the same dilution factor on all previous screw presses in the line by virtue of the same principle as above. Therefore the percent consistency discharged from screw presses can be determined by the exact same method and the exact same equations as presented herein.

An example of the calculations follows to determine the percent consistencies off the discharge side of the drums in a four drum system with dry pulp flow rate of 441 kg/min and a 3.0 dilution factor with the shower flows being 4274, 4032, and 3822 liters per minute respectively for washers 1, 2, and 3 while the last washer No. 4 had a shower flow of 4557 liters per minute. It is seen that the consistencies off washers 1, 2, 3 and 4 are 13%, 14%, 15% and 12% respectively, calculated as follows.

FROM EQUATION(8) PERCENT CONSISTENCY= 100(p)/(p+(b−DF(p)))

THE CONSISTENCIES OFF THE FOUR WASHER DRUMS ARE THEN:

1 PERCENT CONSISTENCY=100(441) / (441+(4274−3(441)))=13%

2 PERCENT CONSISTENCY=100(441) / (441+(4032−3(441)))=14%

3 PERCENT CONSISTENCY=100(441) / (441+(3822−3(441)))=15%

4 PERCENT CONSISTENCY=100(441) / (441+(4557−3(441)))=12%

Conventional Flow Measurement for Showers

Conventional flow measuring devices such as magnetic flow meters, venturi flow meters, vortex shedding meters, mass flow from coriolis force meters, or orifice meters may be used for the determination of the liquid flow measurements on the showers to the washer drums.

Dry Pulp Flow Rate

Conventional percent consistency measurement and control systems and conventional flow measurement systems can be used in determining the rate of production entering the pulp washing system. This supplies the p in the equations presented herein but without the measurement of the shower flows, the known dilution factor, and the constant level in the filtrate tank the percent consistency off the drums as given in Equation (8) cannot be determined.

Alternative Method for obtaining Dry Pulp Flow Rate

A relatively good determination of the discharge percent consistency of all other washer drums can be made by using a value for p in Equation (8) by a total mass measurement off any one of the washers combined with the drum rotational speed of that washer and the dimensions of said washer and an estimated consistency off that washer. This provides an alternative value for the p (rate of dry pulp flow) in the equations. The determination of the percent consistency off the other washers relying on this may not be quite as accurate as the preferred embodiment of this invention but uses the same Equation (8) as presented herein and gives relative values which in many cases are nearly as effective insofar as determining the conditions required for producing the maximum percent consistency off the discharge side of the washers. This is true since the maximum value relative to this estimated percent consistency should be very close to the actual maximum percent consistency. In this system the value for p would be determined by Equation (9) below.

Rate of dry pulp flow in kilograms per minute (p)

$$p=A(R)M(C)/100 \tag{9}$$

Where:

A=area of the drum in square meters

R=rotational speed of drum in revolutions per minute

M=total mass per square meter (as measured by a backscatter gamma gauge) in kilograms per square meter.

C=estimated percent consistency from past experience

Another Alternative for Obtaining Dry Pulp Flow Rate

It is also possible to determine an estimate of the dry pulp flow rate (p) by measuring the total mass per unit time as in U.S. Pat. No. 4,869,784, assigned to the author of this invention, and assuming consistency and thereby arrive at a relative value as above for the percent consistencies on the washer drums discharge. The dry pulp rate can also be determined following the last washer discharge by any other conventional means as this measurement is not a part of this instant invention.

Alternate Dilution Factor Derived From Temperatures

It is well known that a countercurrent pulp washing process is inherently a countercurrent heat recovery system. This is obvious in that the flow of washing liquid is always in the direction of the final liquor recovered and sent to the evaporators. The recovery of heat in this system is directly related to the efficiency of recovery of the hot black liquor plus the additional heat recovered in the hot wash water that penetrates the pulp web on the last washer as dilution factor. As in all heat system there is some small amount of heat lost to the surroundings but for all practical purposes this can easily be determined and eliminated from a heat balance. Using the heat balance portion of a pulp washing computer simulation program it is easily shown that the degree of heat recovery and the temperatures in the system are primarily related to the dilution factor and the temperature of the wash water on the last stage that constitutes the dilution factor. The additional data required for this determination are the temperatures of the liquor filtrates as it is normal to measure the temperature of the final stage shower water. Although the heat balance can be related to these variables in several ways it is seen that one of the best relationships is the difference between the temperature of the second stage filtrate and the fourth stage filtrate. These relationships are particularly valuable in estimating the dilution factor for use in this invention when better means are unavailable. Although the pulp discharge consistency off the washer drums does have an effect on the temperature difference above it only introduces a small deviation compared to the effect of dilution factor. With the last stage shower temperature at 65.5 degrees Centigrade a change in dilution factor from 3.0 down to 1.0 in the simulation program showed the #2 filtrate temperature minus the #4 filtrate temperature was 6.48 degrees C. at 16 percent consistency on all washers and was 5.28 degrees C. at 12 percent discharge consistency on all washers. Obviously then the dilution factor could be estimated by the following equation after measuring the temperature difference between the #2 filtrate and the #4 filtrate in this four stage system.

$$\text{At } 12\%\ CONS\ DF=C1+3.0-(T2-T4-9.3667)\ /\ 2.638 \tag{10}$$

$$\text{At } 14\%\ CONS\ DF=C1+3.0-(T2-T4-8.7055)\ /\ 2.969 \tag{11}$$

At 16% $CONS\ DF=C1+3.0-(T2-T4-8.0833)\ /\ 3.240$ (12)

WHERE : CONS is percent consistency

DF is dilution factor

C1 is a constant correcting for heat loss and the last shower temperature.

T4 is temperature deg. C. of the fourth stage filtrate

T2 is temperature deg. C. of the second stage filtrate

A more complex equation can compensate for the washer consistencies and shower temperatures in this normal range of values. The pulp washing simulation program from which the above numbers were derived does compensate for all the known variables.

The equation to determine the dilution factor where the consistencies and shower temperatures are compensated for in one equation is:

$$DF=-C2+16.68-0.3778(T2-T4)-0.1811(CONS)-0.1178(T1) \quad (13)$$

WHERE:

DF is the dilution factor

C2 is the heat loss correction factor as determined below

T1 is the last shower temperature in degrees Centigrade

T2 is the second stage filtrate temperature in degrees Centigrade

T4 is the fourth stage filtrate temperature in degrees Centigrade

CONS is the average drum discharge percent consistency of all stages

The constant C2 in equation (13) can be determined for any particular operation using inputs from the system into the following equation:

$$C2=-X[2]+16.68-0.3778(T2-T4)-0.1811(CONS)-0.1178(T1) \quad (14)$$

WHERE:

C2 is the constant for the equation (13)

X[2] is the dilution factor calculated from other means such as % liquor solids

T1 is the temperature of the last shower in degrees Centigrade

T2 is the second stage filtrate temperature in degrees Centigrade

T4 is the fourth stage filtrate temperature in degrees Centigrade

CONS is the average drum discharge percent consistency of all stages.

The above equations (10) through (14) give an alternative value for dilution factor to be used in the determination of the pulp discharge consistencies, additionally however these equations give valuable information that may used in the control of the shower flow to the last washer to a given dilution factor. Even though equilibrium values are reached slowly in large filtrate systems it is readily seen that incremental changes toward equilibrium are observed when the dilution factor is changed. Secondly, in a system such as a belt type washer or where multiple stages are on one drum as in the pressure washing systems these same equations apply and the changes are much more rapid and can be a very good control system.

It at first seems strange to use an equation containing consistencies to determine the dilution factor then use that value to determine the same consistencies in equation (8), but this illusion is dispelled upon realizing that this is a continuously running system and only the very first value used on startup of the system need be an estimated value for the consistency and from then on these values are derived from the results of actual mill data input into equations (8) and (13).

Although this explanation and equations are for a four stage system using the second and fourth filtrate temperatures, the same reasoning can be used to determine the equations for any number of stages and for a different choice of temperature points in the determination of the dilution factor.

Second Alternative Dilution Factor Determination Derived From Percent Solids

The percent solids in each filtrate tank changes as the dilution factor is raised or lowered. This of course has been known since the first washing operation was activated. Many attempts have been made to control the amount of shower water from measurements of the percent solids in the filtrate tanks and in fact this is the major method of controlling the shower flow in pulp washing systems today. Primarily the operator determines the percent solids in the first filtrate tank and adjusts the shower water to maintain a given set standard percent solids being sent to the evaporators or some related previous operation. This standard is usually set by the mill management based upon past experience but is left somewhat flexible to adjust to secondary standards that also must be met such as pulp cleanliness (soda loss), pollution control, and even to manage evaporator problems on a temporary basis. It has been discovered however that much like the temperature difference in the previous dilution factor determination the difference in percent solids between two stages presents more leverage and has a better relationship to dilution factor than simply the first stage percent solids or the last stage percent solids and is much more rapid in response to changes in dilution factor. U.S. Pat. No. 4,046,621 to Sexton gives a method to control the shower flow to a washing system using the conductivity of the last stage filtrate as a measure of percent solids. This last stage conductivity (percent solids) was tried as a shower control method by using the percent solids in the downleg of the last washer, as determined with a conductivity probe, and this was called System Balance Indicator and was marketed by Nalco Chemical Company in which some dozen or so systems were sold but all were abandoned as being inadequate. It should be noted at this point however that no attempt was ever made in any of these systems to determine the dilution factor or to control the shower flows to any given dilution factor nor was any attempt ever made to determine the consistency of the pulp leaving any of the washer drums using this data. No measurement was made of the shower flow rate on previous washer drums.

The pulp washing simulation program shows that much like the previously described temperature relationships that by determining the difference between the second and fourth stage filtrate percent solids that the dilution factor can be determined. The equation for this is:

$$DF=C3-1.459(P-0.179(12-CONS))+0.060(P-0.179(12-CONS))^2 \quad (15)$$

WHERE

DF is the dilution factor

C3 is a constant equal to about 9.23 for bleached grade softwood

P is the percent solids in #2 filtrate minus the % solids in #4 filtrate

CONS is the average pulp consistency

The constant C3 can be determined for the various grades of pulp by using a value for DF as derived from the percent liquor solids sent to the evaporators, the total solids per unit weight of pulp and the water addition from chips, steam and cooking liquors.

Again it is understood that the consistency above is a small correction using an estimated value at the start of the system but from then on uses mill data from equation (8) above.

The method of measuring the percent solids in the filtrates can be based upon standard measuring instruments such as refractometers, density measuring systems, back scattered or transmitted nuclear radiation or correlation with conductivity measurements since the method of solids determination is no part of this invention. Once the system is up and running this determination of the dilution factor can then be used to control the shower water on the last stage of wash to this dilution factor.

Controlling Shower Flow in Response to Dilution Factor Determination

Starting from scratch in a system being run by an operator, determine the actual dilution factor being applied by using equation 13 or equation 15, and adjust the shower flow as set forth hereafter to obtain target dilution factor. Step 1. Determine the change in dilution factor required by subtracting the dilution factor as determined in equation 13 or equation 15 from the target dilution factor. Step 2. Multiply this change in dilution factor required by the rate of dry pulp flow in kilograms per minute. Step 3. Add that kilograms per minute change required to the present measured kilograms per minute flow rate of shower flow to achieve the desired target dilution factor and set the shower flow rate to that value. Note that the plus or minus sign of the change value from Step 1 takes care of the increase or decrease in flow rate. That is if the change required is negative, then the flow rate is automatically reduced by virtue of the sign of the change calculated in Step 1 above. The final flow rate as in Step 3 above is then the flow rate for the target dilution factor.

Other Washing Devices

While this invention has been described in terms of a brown stock washing operation for washing cellulose, it may be applied to a variety of operations such as the washing step in bleaching plants where the washer drums are similar to those in a brown stock washing process. The liquid dispensed and measured in this description may be water, recycled water, or chemical treating agents. The material being washed or treated in this step may be some other material such as lime mud or any other slurry being so treated.

Although this invention is not limited to the pulp and paper industry there are several different types of washing equipment used and that all of these different types can benefit from determining the discharge consistencies of each stage. All that is required to determine the consistency of the discharged material is that the factors in equation 8 can be determined. Anyone skilled in the art of pulp washing on different types of equipment can readily see that these factors can be determined either within the washing stage itself or on subsequent stages. Taking the diffusion type washing stage first it is seen that where the diffusion step is followed by a totally closed decker or a drum type washer, the factors in equation (8) are readily obtained from these sources, and the discharge consistency from the diffusion step is then obtained from the given equations. The washing step in a continuous digester is likewise a diffusion type wash and as such the discharge consistency is determined exactly as above using values obtained from subsequent equipment. In both these washing types above the source of the liquor used for the displacement wash in the diffusion type washer is from a totally closed system consisting of either a decker, a drum type washer, a belt type washer described later, or a drum type pressure washer thus giving the required values for equation (8) above. Pressure washers that may contain more than one stage on a single drum provides the same data that is required for equation (8) for itself and for stages or diffusion washers preceding the pressure washer since this constitutes a totally closed system and the dilution factor must remain constant throughout. A belt type washer contains many stages without dilution between by conveying the pulp mat on the wire and collecting the filtrate from each suction box for recycling to the previous stage. The filtrate drains to a very small tank and is almost instantly pumped back to the previous stage on the washer belt. With essentially no storage volume in these tanks the dilution factor is held constant without the need for level control devices. The discharge consistency is determined as in equation (8) and if the system contains one or more previous washing steps such as in a continuous digester this provides the data for equation (8) for previous stages since here again the system is totally closed and the dilution factor must remain the same for all previous steps.

Variations will be evident to those skilled in the art. Therefore, the scope of the invention is intended to defined by the claims.

What is claimed is:

1. A process for controlling a continuously operated wood pulp washing system that removes dissolved impurities from the pulp by a series of countercurrent stages of drum washers, the drum washer of each stage comprising a vat and a continuously moving vacuum filter drum having as a surface, a screen wire having a lower portion protruding into the vat, where the speed of the movement is called drum speed, and being associated with a filtrate tank, where in each stage: incoming pulp may be treated with deaerating aid and is diluted with a flow of filtrate from the same stage denoted vat dilution flow, before entering the vat of that stage, a mat of pulp is formed by draining of a portion of liquid from a pulp suspension in the vat leaving a pulp mat on the screen wire having a higher consistency than the pulp suspension in the vat and forming a filtrate, said filtrate passes through apertures in the screen wire and into the filtrate tank for that stage which is located below the drum washer of that stage such that a vacuum is pulled on the interior of the washer drum to suck liquid out of the pulp suspension to form the pulp mat, a liquid level is maintained in the vat at a set point selected when the system is in proper balance between the vat dilution flow and the drum speed that regulates the hydraulic capacity of the system, the pulp mat formed on the screen wire is transported with the drum to encounter a shower flow coming from the filtrate tank of the following stage except for the final stage where the shower flow is fresh water, the vacuum in the vacuum drum sucks a portion of the shower flow through the pulp mat on the filter drum, the weight of the portion of the shower flow that is sucked through the pulp mat divided by the dry pulp flow which is the weight of wood pulp in the pulp mat without the associated water in the pulp mat being called the dilution factor and the volume of shower flow that is sucked through the pulp mat on the filter drum being called the dilution factor volume, the pulp mat is then transported past the shower flow under a press roll where one is present to press out more of the liquid from the pulp mat and increase the consistency of the pulp mat, the pulp mat then is transported to the discharge side of the vacuum drum where an internal valve of the washer releases vacuum from a portion of the vacuum filter drum, called the vacuum break, and the pulp mat is then discharged from that drum into the beginning of the following washing stage or from the system in the case of the final stage, said process comprising, in each stage, evaluating the influence on percent consistency at the discharge side of a stage of, change in the liquid vat level set point, the vat dilution flow and the drum speed by statistical analvsis of the effect of changes in the liquid vat level set point, the vat dilution flow and the drum speed on consistency at the discharge side of a stage and adjusting and controlling the liquid vat level set point, the vat dilution flow and the drum speed in response to determination of the percent consistency of the pulp mat at the discharge side of that stage and the statistical analysis to increase the percent consistency of the pulp mat at the discharge side of that stage, the percent consistency in the pulp mat at the discharge side of a stage being determined from shower flow rate, dry pulp flow rate and dilution factor based on the equation:

$$\text{Percent consistency}=100(p)/(p+(b-DF(p)))$$

where p is the weight of dry pulp discharged per unit time in kilograms/minute and is measured or calculated, b is the shower flow volume per unit time in liters/minute and is measured for all stages except for the last stage where it is controlled to provide the dilution factor DF.

2. A process as defined in claim 1 wherein the washing system is a brown stock washing system.

3. A process as defined in claim 1 wherein the washing drums are in a bleaching process.

4. A process as defined in claim 1 wherein deaerating aid is added to each stage and the type and amount of it is controlled in response to the determination of the percent consistency at the discharge side of the same stage drum washer.

5. A process as defined in claim 1 further comprising controlling the amount of shower flow applied to the last washing stage in response to dilution factor that is determined by the cooling effect of the dilution factor volume on the liquor temperature in the filtrate tank of the last stage and the temperature of the liquid in the filtrate tank in a previous stage.

6. A process as described in claim 1 further comprising controlling the amount of shower flow applied to the last washing stage in response to the dilution factor that is determined by the diluting effect produced by the dilution factor volume on the percent solids in the last stage filtrate tank and the percent solids in the filtrate of a previous stage.

7. A process as defined in claim 1 where the system contains press rolls and the pressure of the press rolls in a stage is regulated in response to the determination of the consistency at the discharge side of the stage where press rolls are present.

8. A process as defined in claim 1 wherein the vacuum break setting in each stage is set in response to the determination of the percent consistency at the discharge side of the stage.

9. the process as defined in claim 1, wherein the liquid vat level set point, the vat dilution flow and the drum speed are adjusted and controlled to provide the maximum sustainable percent consistency off the discharge side of the filter drum in each stage.

* * * * *